US007444111B2

(12) United States Patent
Kawagoe

(10) Patent No.: US 7,444,111 B2
(45) Date of Patent: Oct. 28, 2008

(54) APPARATUS FOR FORMING IMAGES, METHOD OF MANAGING LOADING OF PAPER FEED CASSETTE IN IMAGE FORMING APPARATUS, AND COPYING MACHINE

(75) Inventor: Hiroshi Kawagoe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 364 days.

(21) Appl. No.: 11/079,747

(22) Filed: Mar. 14, 2005

(65) Prior Publication Data

US 2006/0204254 A1 Sep. 14, 2006

(51) Int. Cl.
*G03G 15/00* (2006.01)

(52) U.S. Cl. ..... 399/391; 399/389

(58) Field of Classification Search ..... 399/391, 399/389

See application file for complete search history.

(56) References Cited

U.S. PATENT DOCUMENTS

| | | | | |
|---|---|---|---|---|
| 2002/0044809 | A1 * | 4/2002 | Hayashi et al. | 399/391 |
| 2003/0133734 | A1 * | 7/2003 | Sugimoto | 399/389 |
| 2004/0047663 | A1 * | 3/2004 | Yano | 399/389 |
| 2004/0136734 | A1 * | 7/2004 | Yokobori et al. | 399/23 |
| 2004/0151525 | A1 * | 8/2004 | Noda | 399/389 |

* cited by examiner

*Primary Examiner*—Anthony H. Nguyen
(74) *Attorney, Agent, or Firm*—SoCal IP Law Group LLP; Steven C. Sereboff; John E. Gunther

(57) ABSTRACT

An image forming apparatus, such as a copying machine is provided. In the device, a predetermined period of time is measured from when an operator has specified a desired size of paper through an operation panel. A duration is measured, during which a paper feed cassette accommodating the desired-size paper specified through the operation panel has been absent from a cassette loading section at a specified loading position. A determination is made as to whether or not an appropriate operational condition has been met by completing loading of a paper feed cassette accommodating the desired-size paper on the cassette loading section, provided that the duration has lasted for more than a certain period of time within the predetermined period of time. When it is determined that the appropriate operational condition has not been met, a warning indicative of the inappropriate operational condition is given through the operation panel.

9 Claims, 6 Drawing Sheets

APPARATUS FOR FORMING IMAGES, METHOD OF MANAGING LOADING OF PAPER FEED CASSETTE IN IMAGE FORMING APPARATUS, AND COPYING MACHINE

BACKGROUND OF THE INVENTION

1. Field of the Invention

This invention relates to an image forming apparatus, such as a copying machine, which is adapted to manage opening/closing states of opening/closing portions such as for paper feed cassettes that can be to operated by a user at the time of use.

2. Related Art

Copying machines have been widespread nowadays as image forming apparatuses, many of which are so arranged that a user can select a desired size of paper to be copied to. Various systems for such a paper size selection have been developed.

One system is to use a plurality of pre-loaded paper feed cassettes, each accommodating paper of a different size, on a plurality of given slots, and to have a user select a paper size to be used through a control panel at the time of use. In this case, selectable paper sizes are unavoidably limited by the types of the pre-loaded paper feed cassettes. This system is suitable for relatively small copying machines.

Another system also enables selection of a paper feed cassette accommodating desired-size paper. In this system, along with the loading of such a paper feed cassette, information on the selected paper size can be manually inputted by keystroke through a control panel. In this case, two options are provided. One is to change (load) a type of paper feed cassette (i.e. paper size) first, and then to perform keystroke input as to the change of paper size through a control panel, and the other is to perform keystroke input first as to change of paper size through a control panel, and then to load a paper feed cassette which accommodates the desired-size paper on a predetermined loading position.

However, in the latter option of changing paper size, if there is a mismatch between an actually loaded paper feed cassette accommodating a certain size of paper and information on a paper size inputted by keystroke through a control panel, and copying is carried out in this state, paper jam may be caused.

One approach for preventing occurrences of such a mismatch is to prevent user's erroneous operation. In order to prevent this erroneous operation, the screen for setting change of paper size may be placed at a hierarchically deep position of a control panel screen avoiding a shallow position (easy-to-open hierarchy). In this way, user's careless or unintentional instructions on paper size may be decreased. This, however, may contrarily decrease operability for paper size change. Particularly, if an emphasis is to be put on the operability, a setting screen may have to be placed in a shallow hierarchy. Thus, prevention of erroneous operation and enhancement of operability have been in a contradictory relation with each other.

Of course, a copying machine may be permitted to have a mechanism in which, when a paper feed cassette has been changed to anther paper feed cassette of a desired paper size, the size of the paper cassette may be automatically detected. Disadvantageously, however, such a mechanism may involve structural complexity and induce increase of manufacturing costs.

SUMMARY OF THE INVENTION

The present invention has been made in view of the circumstances described above, and has an object of preventing or decreasing mismatch between an operational instruction and an actual opening/closing state of each of opening/closing portions, i.e. loading/unloading of a paper feed cassette on/from each of cassette loading sections in an image forming apparatus, such as a copying machine.

The present invention provides an image forming apparatus comprising: an image forming unit for forming an image; opening/closing portions each of which is operated by an operator and is required to be in a closed state at the time of image formation by the image forming unit; and a management unit for managing the opening/closing state of each of the opening/closing portions on a unit time basis.

Further, the present invention provides a copying machine comprising: an image forming unit for forming an image; an operation panel through which an operator can specify a desired paper size; cassette loading sections each of which requires the paper feed cassette accommodating desired-size paper that has been specified through the operation panel, to be loaded on a specified loading position at the time of the image formation by the image forming unit; sensors each outputting a signal indicative of the loading/unloading of the respective paper feed cassettes on the respective loading sections; measuring means for measuring a predetermined period of time starting from the time when the desired paper size has been specified through the operation panel; determination means for determining whether or not an appropriate operational condition has been met by completing the loading of a paper feed cassette accommodating the desired-size paper on the cassette loading section within the predetermined period of time based on the signal from the sensor; and warning means for giving such a warning to an operator that the appropriate operational condition has not been met, provided that a determination has been made accordingly by the determination means.

Further, according to the present invention, a method for managing loading of a paper feed cassette in an image forming apparatus is provided, which comprises steps of: measuring a predetermined period of time from the time when a desired paper size has been specified by an operator through an operation panel; measuring a duration during which the paper feed cassette accommodating the desired-size paper specified through the operation panel has been absent from a cassette loading section at a specified cassette loading position; determining whether or not an appropriate operational condition has been met by completing loading of a paper feed cassette accommodating the desired-size paper on the cassette loading section, provided that the duration has lasted for more than a certain period of time within the predetermined time; and giving such a warning through the operation panel that the appropriate operational condition has not been met, provided that a determination has been made accordingly.

DETAILED DESCRIPTION OF PREFERRED EMBODIMENTS

One embodiment of an image forming apparatus according to the present invention will now be described with reference to FIGS. 1 to 5.

Figure 1:
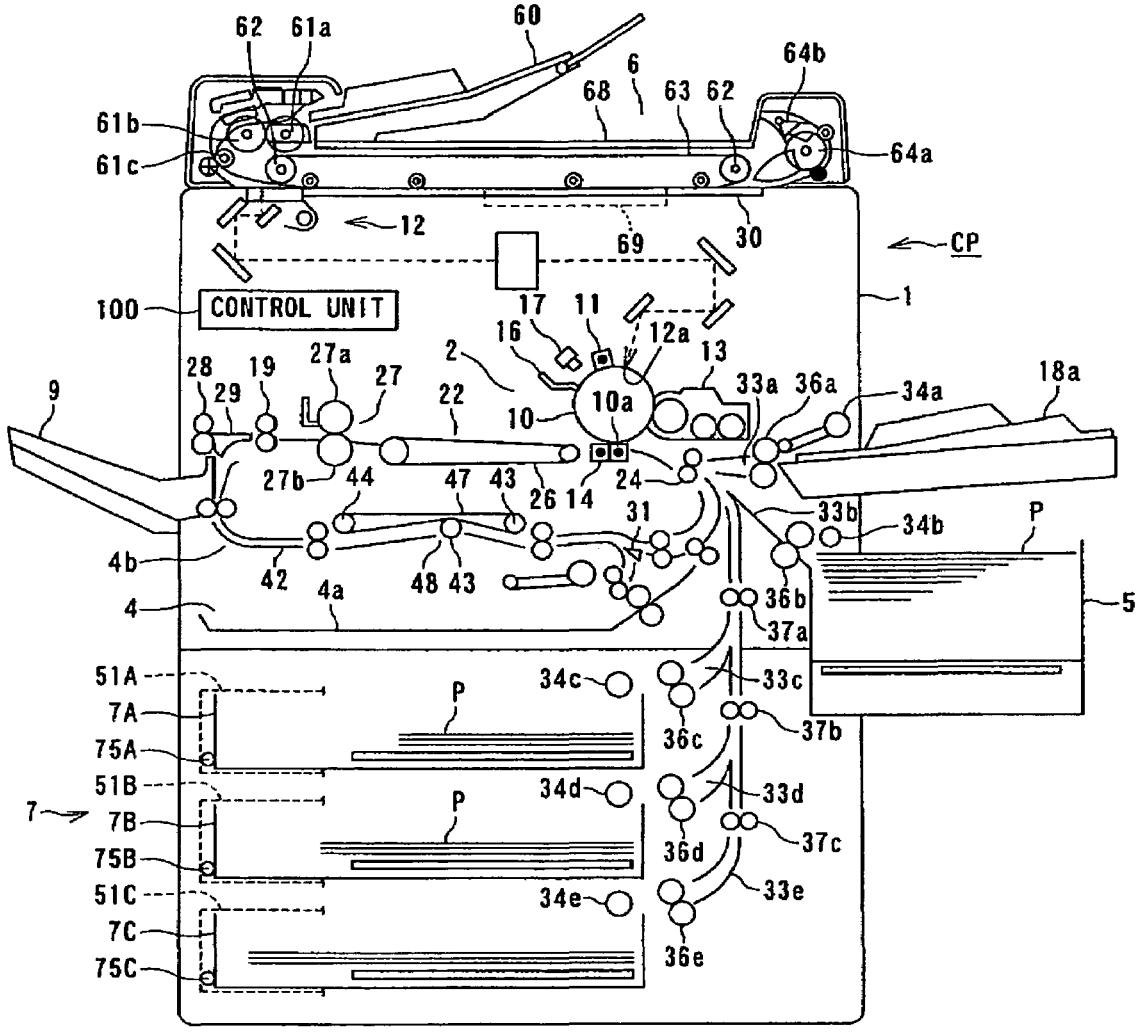
FIG. 1 is a structural schematic diagram illustrating one embodiment of a copying machine as an image forming apparatus according to the present invention.

FIG. 1 schematically illustrates a structure of a copying machine as the image forming apparatus according to the present invention.

As shown, a copying machine CP comprises a device body 1, an original feeder 6, and a paper feeder 7, as well as the components consisting of units and mechanisms necessary for the interiors and peripheries of these devices 1, 6 and 7.

The device body 1 is internally and peripherally provided with an image forming unit 2, an automatic reversing device 4, and a bulk cassette device 5. At the top surface of the device body 1, an original platen 30 is provided, which is equipped with the automatic original feeder 6 for automatically feeding an original. The paper feeder 7 is located so as to load thereon the device body 1.

Specifically, a drum type photosensor 10 is provided at approximately the center of the device body 1. Around the photosensor 10, an electrizer 11, an exposure portion 12*a* of an exposure system 12, a development system 13, a transfer/separation charger 14, a cleaning device 16 and a static eliminator 17 are sequentially provided along its rotation direction to constitute the image forming unit 2. A paper collector 4*a* for the automatic reversing device 4 is provided below the photosensor 10.

A side cassette device 18 having a manual feeder tray 18*a* at its upper part and accommodating paper P, and the bulk cassette device 5 are attached to the central right side, as viewed from the figure, of the device body 1.

Further, the paper feeder 7 is provided with first to third paper feed cassettes 7A to 7C for accommodating plural kinds of the paper P, each having a predetermined size, which are detachably loaded on cassette loading slots 51A to 51C, respectively.

First to fifth conveyer paths 33*a* to 33*e* are formed starting from the respective paper feed cassettes 7A to 7C to a transfer position 10*a* opposed to the transfer/separation charger 14 on the photosensor 10. Along these conveyer paths 33*a* to 33*e*, there are provided: first to fifth pickup rollers 34*a* to 34*e*, respectively, for taking out the paper P from the side cassette device 18, the bulk cassette device 5, and the first to third paper feed cassettes 7A to 7C; first to fifth pairs of separator/conveyer rollers 36*a* to 36*e* for separating and conveying the paper P that has been taken out; and first to third pairs of conveyer rollers 37*a* to 37*c*.

In the device body 1, a main conveyer path 22 is formed for conveying the paper P to a delivery tray 9 through a pair of resist rollers 24, with a toner image being transferred by the photosensor 10, through a pair of fixing rollers 27 consisting of a heat roller 27*a* and a press roller 27*b*, being conveyed thereto by a conveyer belt 26, and through a pair of conveyer rollers 19 and a pair of delivery rollers 28.

A first gate 29 is provided upstream of the delivery rollers 28 in the main conveyer path 22, so that the paper P after completion of fixing is either delivered as it is, or conveyed back to the transfer position 10*a* for double-sided copy or multiple copy. Particularly, a re-conveying device 4*b* consisting of guide plates 42 for passing the paper P being inserted therebetween is provided between the first gate 29 and the transfer position 10*a*, so that the paper P is conveyed to the paper collector 4*a* through a second gate 31.

In the reconveying device 4*b*, a correction device 48 is provided, which consists of a driven roller 43, a fixed driving roller 44, a correction roller 46 which can be oscillated, and a decurler belt 47 serving as a correction belt which is stretched between the driving roller 44 and the correction roller 46 being pressed by the driven roller 43 to thereby guide paper with the help of the guide plates 42.

The automatic original feeder 6 feeds the original copy onto the original platen 30 through an original tray 60, the pickup roller 61*a*, a separating roller 61*b*, and an aligning roller 61*c*, by using a conveyer belt 63 which is bridged between belt rollers 62. After copying is over, the original copy is discharged to a discharge portion 68 being conveyed by the conveyer belt 63 through a reversing roller 64*a* and a discharge roller 64*b*.

A control unit 100 is disposed at a predetermined position in the device body 1. The control device 100 controls the operation of the entire copying machine CP, as described hereinafter, by receiving signals from detection devices, such as sensors, disposed at various portions, and by processing the received signals for production of necessary control signals or display signals. The control unit 100 then transmits the produced signals to output devices, such as a display and a driver.

A control panel (operation panel) 69 is provided at an end portion, i.e. an operator side at the top of the device body 1. The control panel 69 is provided for the purposes of giving information necessary for an operator at the time of copying or maintenance. The control panel 69 includes a numeric keypad, various setting keys including paper size selection keys, and a liquid crystal display screen.

Figure 2:
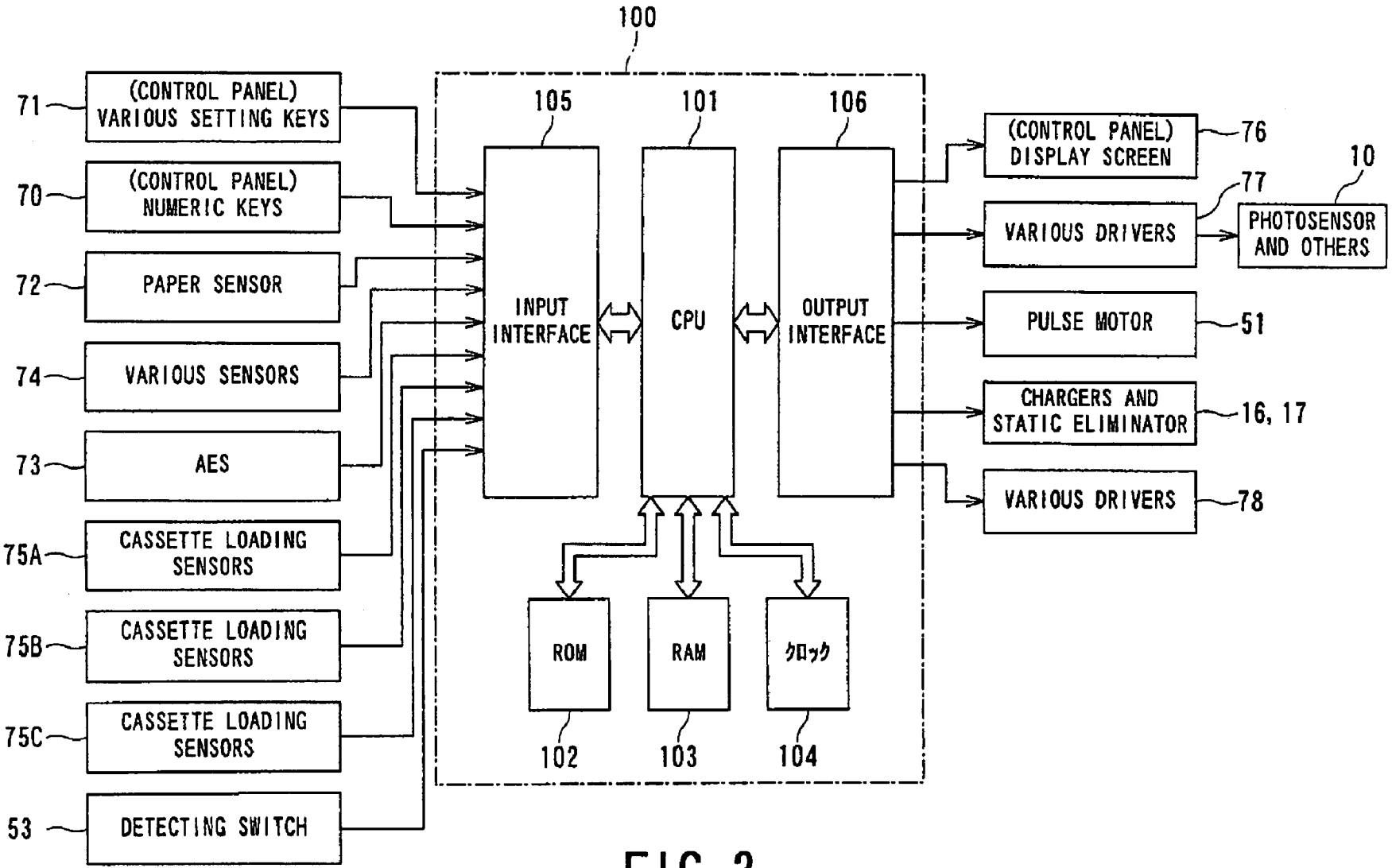
FIG. 2 is a schematic block diagram illustrating a configuration of a control system loaded on the copying machine shown in FIG. 1.

FIG. 2 is a schematic block diagram of a control system centered on the control unit 100. The control unit 100 comprises a CPU (central processing unit) as an arithmetic unit, a ROM 102 storing in advance fixed data such as a control program, RAM 103 for temporarily storing data under operation by the CPU 101, a clock 104 for generating clock signals, an input interface 105, and an output interface 106.

A control program is stored in the ROM 102 in advance, for executing management of loading/unloading, on a unit time basis, of the plurality of paper feed cassettes 7A to 7C accommodating the paper P of different sizes on/from the cassette loading sections 51A to 51C. Accordingly, upon startup, the CPU 101 reads out the control program from the ROM 102 to sequentially execute processes according to the procedures described in the program.

The CPU 101 receives various detection signals from the various detection devices through the input interface 105. These detection devices include: a numeric keypad 70 of the control panel 69; various setting keys 71 (including a print key, and mode switching keys for specifying, such as a single-sided copying mode, a multiple copying mode, and a double-sided copying mode) of the control panel 69; a paper sensor 72 in a paper conveyer path such as the main conveyer path 22; an automatic exposure sensor (AES) 73; a lever position detecting switch 53 for detecting the position of an eccentric cam 52; various sensors 74 for the automatic original feeder 6; and cassette loading sensors 75A to 75C.

Among the detection devices, the cassette loading sensors 75A to 75C are the sensors for detecting the loading/unloading of the plurality of paper feed cassettes 7A to 7C accommodating different sizes of paper on/from the cassette loading slots 51A to 51C. Each of these sensors is comprised, for example, of a limit switch, an optical sensor and a magnetic sensor. The cassette loading sensor 75A (or 75B or 75C) is established at a predetermined position of the cassette loading slot 51A (or 51B or 51C). Thus, when the paper feed cassette 7A (or 7B or 7C) is inserted into-(loaded on) the cassette loading slot 51A (or 51B or 51C), the cassette loading sensor 75A (or 75B or 75C) detects this to turn on a switch signal. Contrarily, when the paper feed cassettes 7A (or 7B or 7C) is drawn out (unloaded), the switch signal is turned off. The manners of turning on/off the signal may be reverse of the above, i.e. the switch signal may be off at the time of loading, and may be on at the time of unloading.

The output signals from these detection devices are read by the CPU 101 through the input interface 105. The input interface 105 plays a role of predetermined signal processing, e.g. A/D conversion of the output signals from the detection devices, and adjustment of voltage level.

The CPU 101 then outputs a control signal, a driving signal, a display signal, or the like, based on the results of the operation, to the various output devices through the output interface 106. Such output devices include: a display screen 76 of the control panel 69; various drivers 77 of a motor (not shown) for driving the photosensor 10 and various rollers or the like including the decurler belt; a pulse motor 51 for moving the correction roller 46 of the correction device 48; various chargers such as the transfer/separation charger 14, and the static eliminator 17; and various drivers 78 for driving such as the pickup roller 61*a* of the automatic original feeder 6, and the conveyer belt 63.

The output interface 106 is provided with a circuit which performs predetermined processes, such as D/A conversion and amplification.

With the copying machine CP structured in this way, an operator, when starting copying, can input image forming requirements, such as a paper size, the number of copies, copying magnification, and a copy mode by operating the control panel 69, while setting an original copy on the original tray 60 of the automatic original feeder 6, or directly setting the original copy at the original platen 30, and switching on a copy key of the control panel 69. In this way, the original copy is duplicated, and the duplicated copy can be obtained from the delivery tray 9, as have been known.

Figure 3:
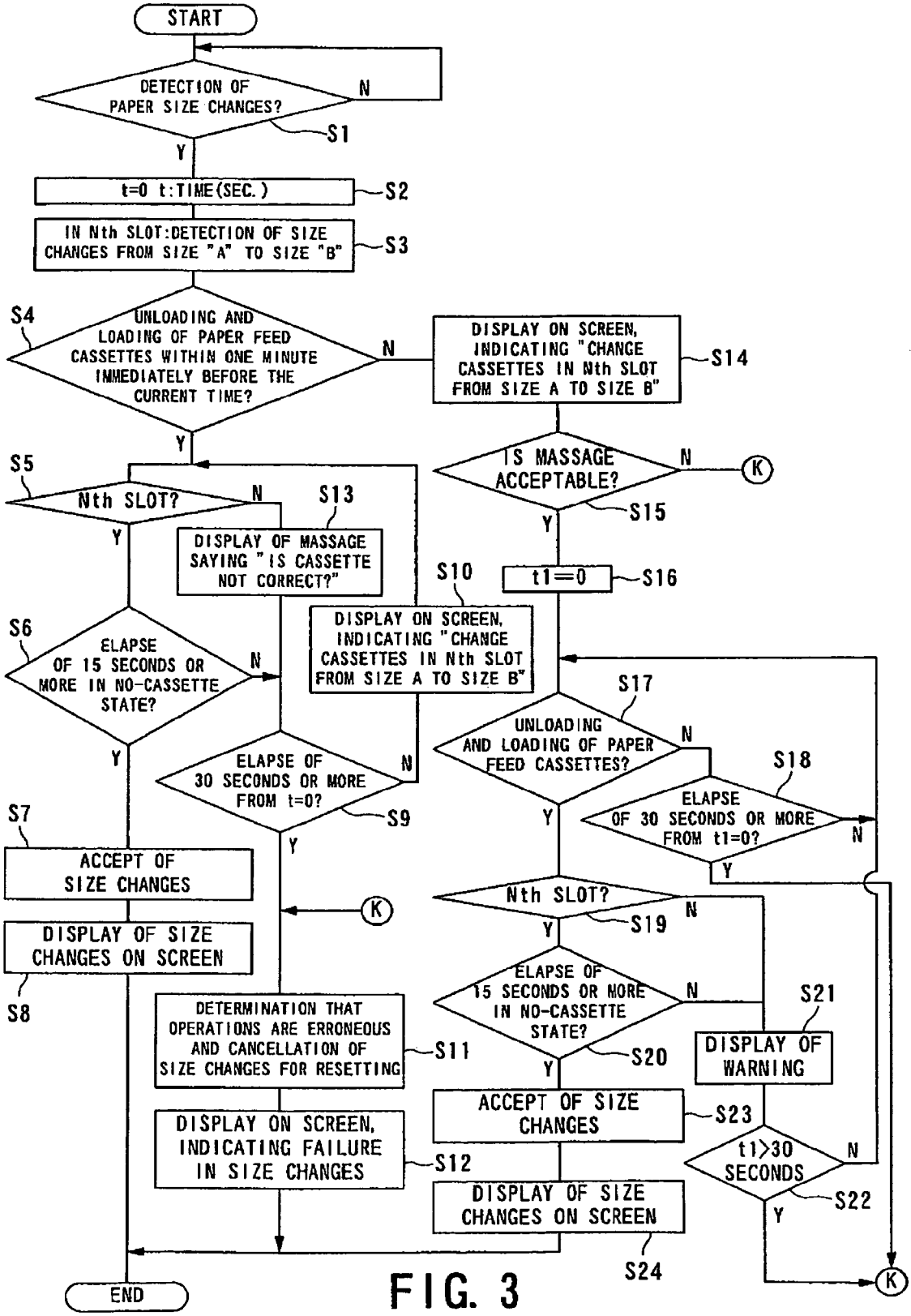
FIG. 3 is a schematic flow diagram illustrating time management at the time of changing a paper feed cassette accompanying the change of paper size, which is executed by a CPU in a control unit.

As shown in FIG. 3, in the copying operation described above, the control device 100, i.e. the CPU 101, individually or in parallel executes the "time management processes for the loading/unloading of the paper feed cassettes 7A to 7C accompanying the paper selection of a desired size" as to the respective cassette loading slots 51A to 51C.

Specifically, the CPU 101 determines (step S1) first whether or not an instruction for changing paper size has been given to a paper feed cassette loaded on the cassette loading slot 51A (or 51B or 51C). This determination is made by reading information inputted by an operator through the paper-size selection keys of the control panel 69. In parallel with this determination, the CPU 101 makes determinations as to the paper feed cassettes 7B and 7C as well which are loaded on the second and the third cassette loading slots 51B and 51C, respectively, according to the present embodiment. Hereinafter, description is focused on a single paper feed cassette.

The CPU 101 then initializes (step S2) the count of a built-in software timer to t1=0, and recognizes (step S3) that, as to an $N^{th}$ (N=1 to 3 in the present embodiment) cassette loading slot 51A (or 511B or 51C), the paper size change is "from size A to size B", for example, from the information inputted through the paper-size selection keys described above. In this way, recognition of change is made as to the paper feed cassette 7A, for example, loaded on the first cassette loading slot 51A, as being from the one for size A to the one for size B.

Subsequently, the CPU 101 determines (step S4), based on a flag, for example, whether or not the paper feed cassette 7A (or 7B or 7C) has been unloaded and another paper feed cassette 7A' (or 7B' or 7C'), has been thereafter loaded during a predetermined period (e.g. one minute) immediately before the current time (refer to the period "Tbefore" in FIG. 4 to be described later).

This determination takes measures for both of the chronological orders with respect to paper size selection, i.e. the operation of the control panel 69 to occur first and then the unloading of the paper feed cassette 7A (or 7B or 7C) to occur second for the loading of another paper feed cassette 7A' (or 7B' or 7C'), and vice versa. Particularly, if the determination is YES, it means that an operator has first loaded the paper feed cassette 7A' (or 7B' or 7C') accommodating a desired-size paper on the $N^{th}$ cassette loading slot (or 51B or 51C), and then has selected the desired paper size through the control panel 69. Contrarily, if the determination is NO, it means that the operator has first selected a desired paper size through the control panel 69. In the latter case, the operator would unload the paper feed cassette 7A (or 7B or 7C) for the A-size paper, which has been loaded on the $N^{th}$ cassette loading slot 51A (or 51B or 51C), and load thereafter the paper feed cassette 7A' (or 7B' or 7C') for the B-size paper.

Let us assume now that the determination has been YES in step S4 (i.e. an operator has first changed or loaded a paper feed cassette). Responsive to this determination, the CPU 101 further determines (step S5) whether or not the cassette loading slot at which the paper feed cassette has been changed or loaded is the $N^{th}$ slot. If YES, further determination is made (step S6) whether or not the period of time when a paper feed cassette was absent from the $N^{th}$ cassette loading slot 51A (or 51B or 51C) has exceeded a certain period of time (e.g. 15 seconds in the present embodiment). The lapse of period is separately counted by the CPU 101 through a process not shown.

When the determination in step S6 results in YES, i.e. when more than the certain period of time has passed after unloading, the CPU 101 estimates that, as sufficient time has passed, the operator has changed a paper feed cassette to the paper feed cassette 7A' (or 7B' or 7C') accommodating the desired-size paper. Thus, the CPU 101 accepts (step S7) the change of paper size recognized in step S3, and displays (step S8) the changed paper size on the display screen of the control panel 69.

On the other hand, when the determination made in step S6 is NO, it means that sufficient time (15 seconds in the present embodiment) has yet to lapse. In this case, the CPU 101 determines (step S9) whether or not more than a predetermined period of time (30 seconds in the present embodiment (refer to the period "Tafter" in FIGS. 4 and 5 to be described later)) has passed since the detection (steps S1 and S2) of change of paper size. If this determination results in NO, the CPU 101 permits the control panel 69 to display (step S10) a message on the display screen saying "Change the paper feed cassette in the $N^{th}$ slot from the one for size A to the one for size B", and then control is transferred to step S5.

The determination in step S9 may result in YES. This falls in the case where the time limitation (30 seconds) has lapsed before the lapse of the certain period of time (e.g. 15 seconds in the present embodiment) during which a paper feed cassette was absent from the $N^{th}$ cassette loading slot 51A (or 51B or 51C). In this case, it is recognized that an operator actually has not loaded a paper feed cassette for another size on the $N^{th}$ cassette loading slot 51A (or 51B or 51C). Accordingly, the CPU 101 determines that the paper size change operation by the operator has been erroneous, resets (step S11) the display setting in respect of the change of paper size, and displays (step S12) a message informing of the erroneous operation on the display screen of the control panel 69. This message may be, for example, "Paper size change operation is in error. Start from the beginning."

The determination in step S5 described above may result in NO in such a case that the position of the cassette loading slot 51A (or 51B or 51C) subjected to paper size change is different from the position of the cassette loading slot 51B (or 51A or 51C) which has actually been subjected to the unloading/loading of a paper feed cassette. In this case, the CPU 101 displays (step S13) such a message on the display screen of the control panel 69 saying, for example, "Is the paper feed cassette not correct?", and then proceeds to the process at step S9 as described above. Thus, control is transferred to either a step S11 route or a step S12 route while repeating the processes at steps S9, S10, S5 and S6 as described hereinabove.

Hereinafter is described a case where the determination made in step S4 results in NO. This NO determination is made in a circumstance where an operator first instructs change of paper size through the control panel 69, and then actually changes (unloads/loads) a paper feed cassette. In association with the NO determination, the CPU 101 sequentially executes the processes at step S14 and the subsequent steps.

First of all, such a message is indicated (step S14) on the display screen of the control panel 69 saying, for example, "Paper size change instruction as to the $N^{th}$ paper feed cassette accepted (size A to size B). Insert B-size paper feed cassette." This message convinces an operator that the paper size change instruction given through the control panel 69 has been recognized, while on the other hand this message may permit the operator to readily notice his/her unintentional paper size change (erroneous operation). An interrogative message may be added to this display, saying "Paper size change is to be cancelled?"

The CPU 101 then interactively makes a confirmation (step S15) with the operator as to whether or not the message displayed in step S14 is acceptable. If an affirmative confirmation is obtained, the count of the software timer is initialized (step S15) to t1=0. If the confirmation process results in negative, control is returned to step S11 described above to carry out corrective processes and indications for the erroneous operation.

After the initialization of the timer t1, a determination is made, by using a detection signal from the cassette loading sensor 75A (or 75B or 75C), as to whether or not the change (unloading/loading) of a paper feed cassette has actually taken place (step S17). This determination NO, i.e. that no cassette change has actually been taken place, allows control to be transferred to a standby mode (steps S17 and S18) to wait for a predetermined period of time (30 seconds in the present embodiment) from when the operator's confirmation would be obtained as to performing change of cassette. In case the predetermined time (30 seconds) has lapsed during the standby mode without the actual change of a cassette, the CPU 101 transfers control to steps S11 and S12 described above to carry out corrective processes for the erroneous operation in the similar manner as described above.

On the other hand, if the change of a paper feed cassette takes place during the standby mode (step S17; YES), it is found out (step S19) if the change has surely been subjected to the $N^{th}$ cassette loading slot 51A (or 51B or 51C). In addition, it is determined (step S20) that whether or not the certain period of time (15 seconds in the present embodiment) has lapsed with a paper feed cassette being absent (unloaded) from the $N^{th}$ cassette loading slot 51A (or 51B or 51C), as at step S6 described above.

If NO determination is made in either of step S19 or step S20, the CPU 101 determines (step S22) whether or not the count of the software timer t1 has expired the predetermined time of 30 seconds, while giving the warning indication (step S21) as described in relation to step S13. For this determination, the processes at steps S17 to S22 are repeated until the expiration of the predetermined 30-second period of time. In this way, the CPU 101 executes detection of the change of a new paper feed cassette, recognition of a position of a cassette loading slot, and management of time. If an appropriate change is still not achieved by this (step S22; YES), the corrective processes for the erroneous operation are executed at steps S11 and S12.

On the other hand, in case the determination in step S20 results in YES, it means that confirmation has been ensured within the predetermined period of time (30 seconds) as to the absence of a paper feed cassette for the certain period of time from the $N^{th}$ cassette loading slot 51A (or 51B or 51C), which is a predetermined position for loading a cassette. In this case, it is recognized that an appropriate change has been made by loading the paper feed cassette 7A (or 7B or 7C) accommodating the desired B-size paper. Accordingly, the CPU 101 accepts the change of the paper size as recognized as at steps S7 and S8 (step S23), displays (step S24) the changed paper size on the display screen of the control panel 69, and then terminates control.

The timing as to the availability in the acceptance of paper size change in accordance with the time management described above, may be summarized as shown in FIGS. 4 and 5.

Figure 4:
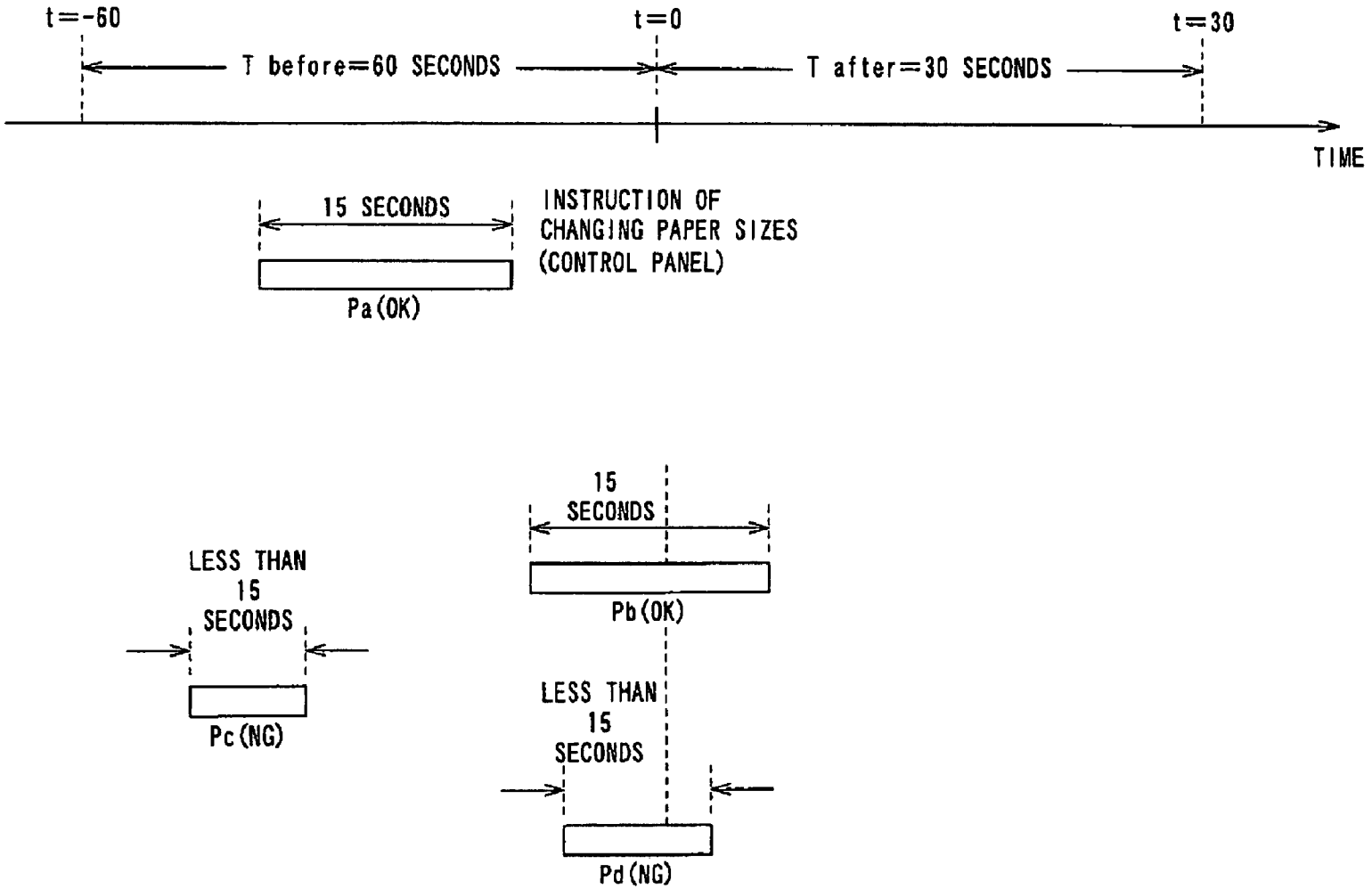
FIGS. 4 and 5 are timing diagrams each schematically illustrating the time management.

The timing diagram of FIG. 4 shows a state corresponding to steps S1 to S13 of FIG. 3 as described above, i.e. a state where change of a paper feed cassette is carried out firstly. In this case, with reference to a point (t=0) of a paper size change instruction through the control panel 69, time management is subjected to an immediately preceding predetermined period of time Tbefore (1 minute) (t=−60), and an immediately ensuing predetermined period of time Tafter (30 seconds) (t=30). If the absence (unloading) of a paper feed cassette from the $N^{th}$ cassette loading slot 51A (or 51B or 51C) for more than the certain period of time (15 seconds) can be confirmed during the total period (Tbefore+Tafter) of time, as shown by a pattern Pa or a pattern Pb in the figure, the paper size change is accepted as being appropriate. Other patterns Pc and Pd both indicate NG and are subjected to warning indication. These patterns Pc and Pd each indicate that the period of time when a paper feed cassette was absent was less than the certain period of time (15 seconds).

Figure 5:
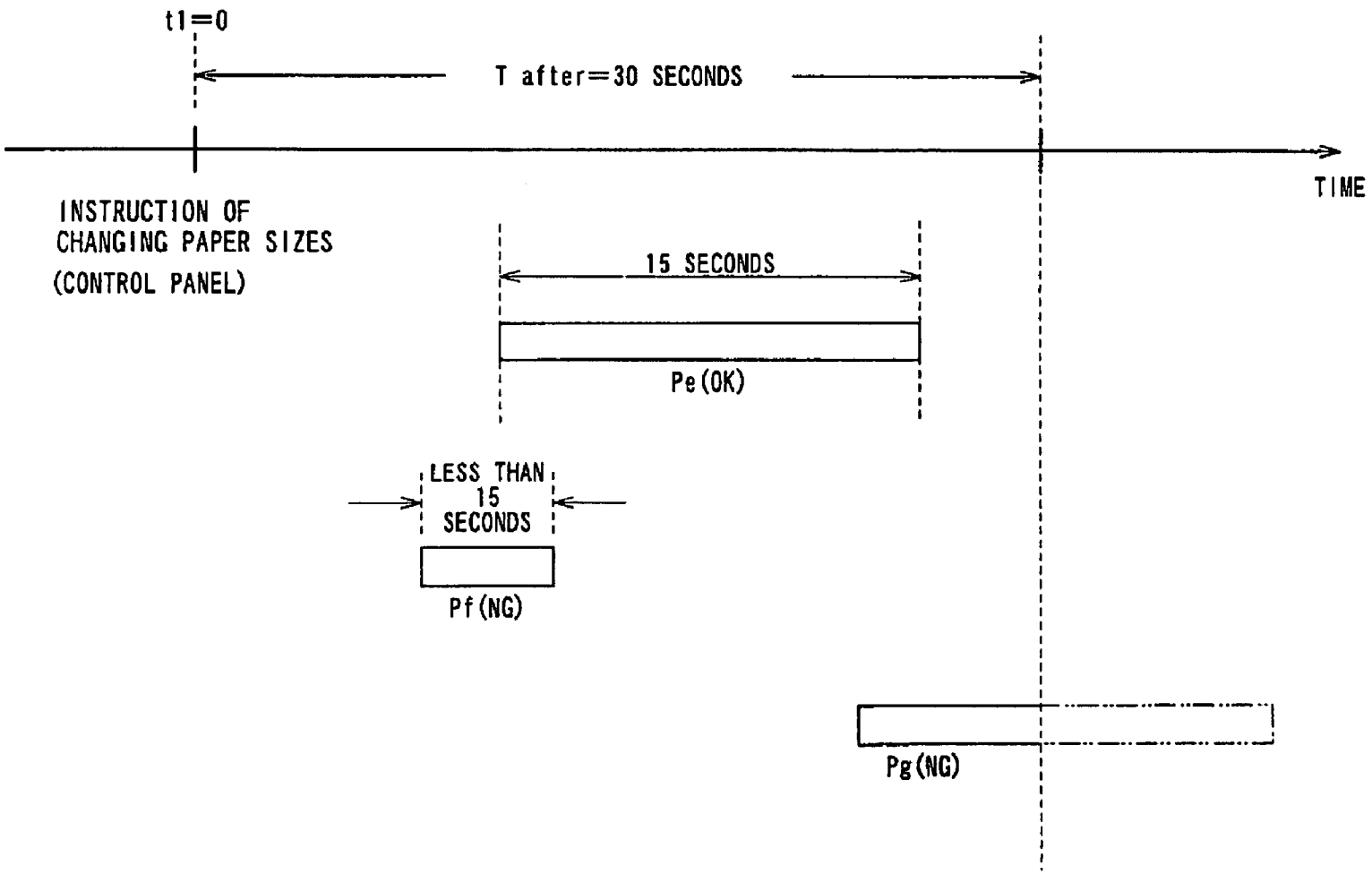

The timing diagram shown in FIG. 5 shows a state corresponding to steps S1 to S4 and S14 to S24 of FIG. 3 as described above, i.e. a state where a paper size change instruction is given firstly, and then change of a paper feed cassette is carried out. In this case, with reference to the point (t=0) of a paper size change instruction through the control panel 69, time management is subjected to the immediately ensuing predetermined period of time Tafter (30 seconds) (t=30). If the absence (unloading) of a paper feed cassette from the $N^{th}$ cassette loading slot 51A (or 51B or 51C) for more than the certain period of time (15 seconds) can be confirmed during the period Tafter as shown by a pattern Pe, the paper size change is accepted as being appropriate. Other patterns Pf and Pg both indicate NG and are subjected to warning indication.

The patterns Pf indicates that the period of time when a paper feed cassette was absent was less than the certain period of time (15 seconds), and the pattern Pg indicates that a paper feed cassette was attempted to be changed in a period exceeding the immediately ensuing period of time Tafter.

As described above, according to the present embodiment, when a paper size change instruction is received through the control panel 69, the predetermined periods of time set immediately before/after therefrom or immediately after therefrom are subjected to time management. The paper feed cassette 7A (or 7B or 7C) of the corresponding cassette loading slot 51A (or 51B or 51C) is then checked as to the loading/unloading for more than the certain period of time (15 seconds in the present embodiment). This certain period of time is the time generally considered to be appropriate for actually changing a paper feed cassette associated with the paper size change, and therefore is not necessarily be intended to be limited to 15 seconds. If the check results in that the paper feed cassette has not been unloaded, or that, even though unloaded, the certain period of time has not lapsed (practically, change of a paper feed cassette in less than 15 seconds is difficult), the CPU 101 then recognizes that an operator has not actually changed, or could not change, or has stopped changing the paper feed cassette. This is regarded as a user's inappropriate operation (erroneous operation), so that the paper change is cancelled on the side of the device and a resultant indication is given. Additionally, when the order of a cassette loading slot is in error, a warning is also indicated accordingly.

In this way, an operator may be allowed to recognize in advance the possibility of his/her erroneous operation, or at least the operator may be given a warning, if required, before actually proceeding to copying operation, thereby decreasing the frequency of an operator's erroneous operation. Thus, practically all the time, the paper size specified by an operator comes to match the paper size fed from a paper feeder tray, which significantly decreases the possibility of occurrences of paper jam at the time of copying. As a result, CS (Customer Satisfaction) may be improved. Further, such a management enables placing the paper size change screen in the control panel 69 at a hierarchically shallow position for easy operation to thereby maintain good operability. Consequently, a good balance can be provided between the operability for an operator at the time of paper size change, and the decrease/prevention of erroneous operations.

Moreover, in comparing with a conventional configuration having a mechanism in which a paper size is automatically detected in association with a paper size change operation, the present invention can avoid structural complexity and increase of manufacturing costs.

In the present embodiment, no measure is taken for stopping copying operation even if an operator's paper size change operation is inappropriate (erroneous operation). This is because the operation is allowed to be ultimately at an operator's discretion, however, the device may be so configured that in some instances the copying operation is stopped.

Figure 6:
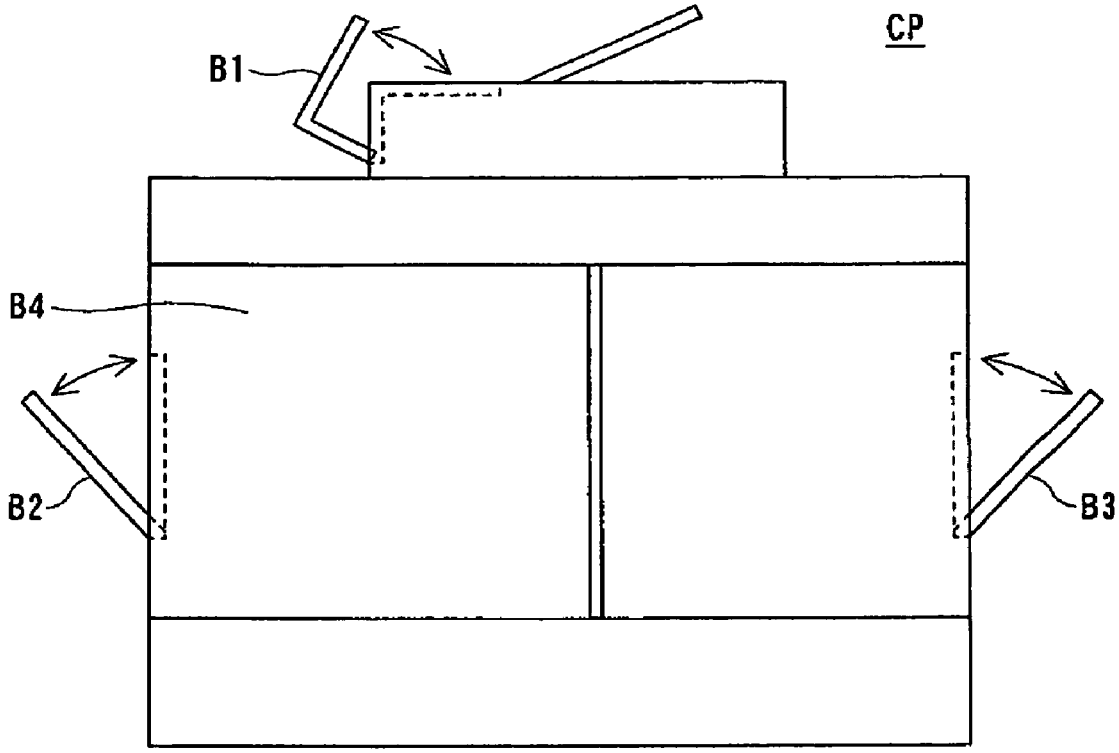
FIG. 6 is an illustration showing another example of opening/closing portions of an image forming apparatus.

Another embodiment according to the present invention may be exemplified, in which the opening/closing portions are disposed at different positions than the firstly provided embodiment. For example, as shown in FIG. 6, a jam processing cover B1 may be provided at an original feeder, a left-side cover B2 and a right-side cover B3 may be provided on the left and right sides of the device body, respectively, and/or a front cover B4 may be provided at the front of the device body of the copying machine CP. These covers are required to be closed at the time of copying operation. Therefore, the embodiment may be configured such that, in case of an inappropriate operational condition wherein a cover is not brought to a closed state after expiry of a predetermined period of time from when the cover has been detected as being open, a warning may be given through the control panel 69. In this way, characteristics of time management may be effectively exhibited for the opening/closing portions of a copying machine.

In connection with the cassette loading sensor 75A (or 75B or 75C) described above, the configuration may not necessarily be such that one sensor is provided per one paper feed cassette. For example, two sensors may be provided at different positions of a paper feed cassette along its drawing direction to further improve the precision of detection of unloading/loading of the paper feed cassette.

In one modification, the warning indication at steps S12 and S20 may include not only a warning but also information on a correct position (an order) of a paper feed cassette and on paper sizes before and after change. This may help an operator in redoing an operation in case of having made an erroneous operation against the operator's intended change.

The numerical values of 60 seconds or 15 seconds described above are not limited to these, but may be larger/smaller values to attain an appropriate condition depending on cases.

Further, a copying machine has been exemplified as an image forming apparatus according to the present invention, however, such a copying machine is not limited to the one having a single copying function, but may be the one having composite functions.

The present invention has been described hereto by providing the embodiments in which the concept of the present invention is implemented in the most specific and preferred manner. However, the present invention may be implemented in other ways without departing from the scope of the invention, and thus may not be limited to the descriptive details of the disclosure provided above.

What is claimed is:

1. A copying machine comprising:

an image forming unit for forming an image;

a paper feed cassette for accommodating a paper on which the image is to be formed;

an operation panel for inputting an instruction for changing the size of the paper in conjunction with the paper feed cassette;

a cassette loading section configured to load/unload the paper feed cassette thereon/therefrom;

a sensor outputting a signal indicative of loading/unloading of the respective paper feed cassette on/from the cassette loading section; and determination means for determining that the paper size change has been done appropriately by determining that the paper feed cassette accommodating the size of paper to be changed has been loaded within a first predetermined time period immediately before the instruction is inputted or within a second predetermined time period immediately after the instruction is inputted, and that an unloaded period of the cassette loading section is more than a third predetermined period.

2. The copying machine according to claim 1, further comprising:

warning means for displaying a warning to the effect if the determination means determines that the paper size change has not been done appropriately.

3. The copying machine according to claim 1, further comprising:

canceling means for canceling the instruction for changing the size of the paper if the determination means determines that the paper size change has not been done appropriately; and display means for displaying information indicating that the instruction has been canceled.

4. A method for managing loading of a paper feed cassette in an image forming apparatus, comprising steps of:

forming an image;

accommodating a paper on which the image is to be formed in a paper feed cassette;

inputting an instruction for changing the size of the paper in conjunction with the paper feed cassette from an operation panel;

loading/unloading the paper feed cassette on/from a cassette loading section;

outputting from a sensor a signal indicative of loading/unloading of the paper feed cassette on/from the cassette loading section; and determining that the paper size change has been done appropriately by determining that the paper feed cassette accommodating the size of paper to be changed has been loaded within a first predetermined time period immediately before the instruction is inputted or within a second predetermined time period immediately after the instruction is inputted, and that an unloaded period of the cassette loading section is more than a third predetermined period.

5. The method according to claim 4, further comprising the step of:

displaying a warning to the effect if the determining determines that the paper size change has not been done appropriately.

6. The method according to claim 4, further comprising the steps of:

canceling the instruction for changing the size of the paper if the determining determines that the paper size change has not been done appropriately; and displaying information indicating that the instruction has been canceled.

7. An image forming apparatus comprising:

an image forming unit for forming an image;

a paper feed cassette for accommodating a paper on which the image is to be formed;

an operation panel for inputting an instruction for changing the size of the paper in conjunction with the paper feed cassette;

a cassette loading section configured to load/unload the paper feed cassette thereon/therefrom;

a sensor outputting a signal indicative of loading/unloading of the respective paper feed cassette on/from the cassette loading section; and determination means for determining that the paper size change has been done appropriately by determining that the paper feed cassette accommodating the size of paper to be changed has been loaded within a first predetermined time period immediately before the instruction is inputted or within a second predetermined time period immediately after the instruction is inputted, and that an unloaded period of the cassette loading section is more than a third predetermined period.

8. The image forming apparatus according to claim 7, further comprising:

warning means for displaying a warning to the effect if the determination means determines that the paper size change has not been done appropriately.

9. The image forming apparatus according to claim 4, further comprising:

canceling means for canceling the instruction for changing the size of the paper if the determination means determines that the paper size change has not been done appropriately; and display means for displaying information indicating that the instruction has been canceled.

* * * * *